US011473492B2

(12) United States Patent
Crouch

(10) Patent No.: US 11,473,492 B2
(45) Date of Patent: Oct. 18, 2022

(54) RADIATOR FILLER NECK

(71) Applicant: Benjamin Shane Crouch, South Australia (AU)

(72) Inventor: Benjamin Shane Crouch, South Australia (AU)

( * ) Notice: Subject to any disclaimer, the term of this patent is extended or adjusted under 35 U.S.C. 154(b) by 0 days.

(21) Appl. No.: 17/508,070

(22) Filed: Oct. 22, 2021

(65) Prior Publication Data

US 2022/0136429 A1 May 5, 2022

(30) Foreign Application Priority Data

Nov. 4, 2020 (AU) ..... 2020904012
Aug. 5, 2021 (AU) ..... 2021212074

(51) Int. Cl.
*F01P 11/04* (2006.01)
*F01P 11/02* (2006.01)

(52) U.S. Cl.
CPC ..... *F01P 11/0276* (2013.01); *F01P 11/04* (2013.01)

(58) Field of Classification Search
CPC ..... F01P 11/02; F01P 11/04; F01P 11/0276; F16K 27/12
See application file for complete search history.

(56) References Cited

U.S. PATENT DOCUMENTS 3,910,451 A * 10/1975 Tusing ..... F01P 11/0285 220/360
4,185,751 A * 1/1980 Moore ..... F01P 11/0238 220/203.26
4,461,342 A * 7/1984 Avrea ..... F01P 11/02 165/104.32
5,169,015 A * 12/1992 Burke ..... F01P 11/0247 220/203.07
5,248,052 A * 9/1993 Mellinger ..... F01P 3/2207 220/203.23
5,722,556 A * 3/1998 Ota ..... B29C 45/26 220/785
6,390,318 B1 * 5/2002 Tanaka ..... F17C 13/04 220/203.26
9,683,479 B2 * 6/2017 Cha ..... F01P 7/14
2002/0189559 A1 * 12/2002 Hewkin ..... F01P 11/029 165/104.32
2008/0264941 A1 * 10/2008 Hebert ..... F01P 11/0238 220/203.07
2014/0331704 A1 * 11/2014 Kondrk ..... F16K 27/12 62/190

* cited by examiner

*Primary Examiner* — Long T Tran
(74) *Attorney, Agent, or Firm* — Ware, Fressola, Maguire & Barber LLP

(57) ABSTRACT

A radiator filler neck for use with a radiator includes a core between upper and lower tanks and a pressure-valve radiator cap. The filler neck includes a hollow cylindrical body including a side wall between upper and lower openings. The upper opening includes an upper sealing seat for the radiator cap. The lower opening includes an internal sealing seat for the pressure valve of the radiator cap. The body has an interior within the side wall and between the upper and lower openings. An overflow aperture is provided in the interior of the body to permit transfer of overflow from the interior via an overflow passage to a concealed exterior overflow outlet; and the side wall does not include a visible exterior overflow outlet.

12 Claims, 6 Drawing Sheets

RADIATOR FILLER NECK

RELATED APPLICATION

This application claims priority from Australian provisional patent application 2020904012 filed on 4 Nov. 2020 and Australian non-provisional application 2021212074 filed on 5 Aug. 2021. The contents of both applications are incorporated herein by reference.

TECHNICAL FIELD OF THE INVENTION

The present invention relates to radiators that form part of the engine cooling system of motor vehicles, being radiators that receive circulating coolant that has been heated in an engine block, which is then cooled in the radiator by air flowing through the radiator, for return to the engine block. Radiators of this type typically include a filler neck to which is fitted a filler cap with a pressure-relief valve, the filler neck permitting addition of fresh coolant to the radiator and thus to the cooling system.

BACKGROUND OF THE INVENTION

In normal operation, a water-cooled engine has interconnected coolant channels running through it, with all the channels converging to a single outlet at the top of the engine. A pump drives hot coolant out of the engine to a radiator, which is a form of heat exchanger, and unwanted heat is passed from the radiator into an air stream, with the cooled liquid then returning to an inlet at the bottom of the engine to flow back into the channels again.

Usually the pump sends coolant up through the engine and down through the radiator, taking advantage of the fact that hot water expands, becomes lighter and rises above cool water when heated. Its natural tendency is to flow upwards, and the pump assists circulation.

The radiator is linked to the engine normally by rubber hoses, and has upper and lower tanks connected by a core, the core being a bank of many fine tubes. The tubes pass through holes in a stack of thin sheet-metal fins, so that the radiator core has a very large surface area and can lose heat rapidly to the cooler air passing through it. The upper tank includes a coolant inlet, normally in the form of a radiator filler neck sealed with a removable radiator cap, and the lower tank includes a coolant drain.

On most motor vehicles the tubes of a radiator run vertically, hence the above reference to "upper" and "lower" tanks. However, many modern, customised or racing vehicles have crossflow radiators with tubes that run from side to side, meaning that the two tanks are more appropriately referred to as side tanks, or inlet and outlet tanks. Nonetheless, for the sake of convenience throughout this specification, reference will continue to be made to the more traditional upright configuration and thus to there being upper and lower radiator tanks. In doing so, it is to be understood that this reference is not to limit the filler neck of the present invention to any particular in-use orientation.

In an engine at its ordinary working temperature, the coolant is only just below normal boiling point. The risk of boiling is avoided by increasing the pressure in the system, which raises the boiling point. The extra pressure is limited by the use of a radiator cap that has a pressure valve in it, such that excessive pressure opens the valve, allowing coolant to flow out of the filler neck through an overflow aperture via an overflow outlet. In a cooling system of this type, there is thus a continual slight loss of coolant if the engine runs very hot and the system needs topping up from time to time. Alternatively, most modern vehicles include a sealed system in which any overflow goes into an expansion tank, from which it is sucked back into the engine when the remaining liquid cools.

In some vehicles, there is an aim to minimise or simplify the appearance of many parts of an engine, including non-engine parts housed in an engine bay, particularly for customised, restored or show vehicles (such as "Street Cars" and "Hot Rods") where engine aesthetics is more important than it otherwise might be. Minimising or simplifying an engine bay is often referred to as "smoothing" an engine bay, and might including re-running wiring and tubing so as to hide it, filling holes, removing unnecessary items, or simply hiding parts behind other parts. Of course, it would also be important in such situations to have clean and/or new parts wherever possible, and often to replace existing parts with equivalent parts that might be coloured or stainless steel and the like.

A vehicle's radiator is one of the most visually prominent parts in an engine bay, often visible even with an engine hood lowered, primarily due to its normal location at the front of an engine. Indeed, the upper portions of a radiator are usually very visually prominent in an engine bay, meaning that the appearance and positioning of a radiator filler neck and its cap are often primary deliberations in the smoothing of engine bays. Thus, it would be beneficial if the overflow tubing often required for use with radiators could be omitted or hidden while still using reasonably standard radiator tanks, filler necks and caps.

Before turning to a summary of the solution provided by the present invention, it should be appreciated that reference to any prior art in this specification is not, and should not be taken as, an acknowledgment or any form of suggestion that this prior art forms part of the common general knowledge in any country. It should also be appreciated that a reference to "vehicle", or to specific types of vehicles, throughout this specification is not intended to be a limitation of the type of vehicle or type of radiator that the radiator filler neck of this invention might be used with.

SUMMARY OF THE INVENTION

The present invention provides a radiator filler neck for use with a radiator, the radiator having a core between upper and lower tanks, and a pressure-valve radiator cap, the filler neck including:

a hollow cylindrical body including a side wall between upper and lower openings, the upper opening including an upper sealing seat for the radiator cap, the lower opening including an internal sealing seat for the pressure valve of the radiator cap, the body thus having an interior within the side wall and between the upper and lower openings;

wherein an overflow aperture is provided in the interior of the body to permit transfer of overflow from the interior via an overflow passage to a concealed exterior overflow outlet, and wherein the side wall does not include a visible exterior overflow outlet.

The radiator filler neck of the present invention may include more than one overflow aperture in the interior of the body, each overflow aperture permitting transfer of overflow from the interior via a respective overflow passage to a respective concealed exterior overflow outlet. For example, two, three or four arrangements of overflow aperture, passage and concealed outlet may be provided, positioned ideally symmetrically about the cylindrical body of the filler neck.

In one form of the present invention, the cylindrical body is annular with a side wall thickness that is large enough such that the side wall can form, on its top edge at the upper opening, the upper sealing seat upon which a sealing flange of a radiator cap can rest so as to seal the filler neck when properly engaged with the radiator cap. Additionally, it is normal to provide at the upper opening of a filler neck, on the exterior of the side wall, suitable engagement grooves in the side wall for correspondingly shaped engagement lugs on the radiator cap to slidingly engage with when securing the radiator cap to the filler neck. Therefore, the side wall thickness of the cylindrical body also needs to be large enough to allow formation of these engagement grooves without impacting on the integrity of the filler neck.

The internal sealing seat of the cylindrical body will normally be a radially inwardly directed annular flange formed integrally with the bottom edge of the cylindrical body, the flange being wide enough such that the pressure valve of a radiator cap can seal against it when the radiator cap is secured to the filler neck. As will be appreciated by a skilled addressee, when the pressure within the radiator and engine cooling system increases above a set-point predetermined by the configuration of the pressure valve, the pressure valve unseats and permits coolant to overflow through the lower opening of the filler neck from the radiator core and the upper tank into the interior of the radiator filler neck. The subsequent functioning of the overflow aperture, the overflow passage and the overflow outlet of the radiator filler neck of the present invention will be described further below.

During assembly of the radiator, the cylindrical body of the filler neck is preferably rigidly attached, such as by welding, at its lower end to an opening in the upper tank, so as to permit coolant to be added to the cooling system through the upper opening of the filler neck, through the interior of the cylindrical body and through the lower opening of the filler neck, into the radiator core and the upper tank. This attachment results in a portion of the cylindrical body being outside and above the upper tank, being a portion whose exterior is thus visible when the radiator is in use, and a portion (usually a much smaller portion) being inside the upper tank and thus being concealed from view when the radiator is in use.

Indeed, so as to avoid unnecessary obstructions in the upper tank, the cylindrical body may be welded to the upper tank at its lowermost extent, such that the bottom edge of the cylindrical body is flush (or substantially flush) with the inner surface of the upper tank wall.

In both of these forms of attachment of the filler neck to the upper tank, the bottom edge of the cylindrical body is exposed only to the interior of the upper tank.

As mentioned above, the radiator filler neck of the present invention includes an overflow aperture in the interior of the cylindrical body, which is located to permit transfer of overflow from the interior, via its overflow passage, to a concealed exterior overflow outlet, without there being a visible overflow outlet on any portion of the side wall that is externally visible (externally visible from the point of view of someone viewing a fully assembled radiator in situ in an engine bay of a vehicle). In a preferred form, the overflow passage is formed within the side wall of the cylindrical body from the interior overflow aperture to the concealed exterior overflow outlet.

In one form, the overflow passage is formed within the side wall, passing through the side wall to exit the filler neck from the bottom edge of the cylindrical body, the passage thus obviously being of a diameter that is less than the thickness of the side wall. In this form, the overflow aperture in the interior of the cylindrical body could be located anywhere in the interior, and only need be configured so as to open to the overflow passage within the side wall, permitting fluid flow from the interior through the passage to the overflow outlet. In this form, the overflow outlet is concealed due to the location of the bottom edge of the side wall within the upper tank. Once again, this concealment is from the point of view of someone viewing a fully assembled radiator in situ within the engine bay of a vehicle.

The overflow outlet may be any suitable form of outlet, and may for instance simply be an internally threaded aperture that is suitable for receiving and engaging with a threaded overflow tube, itself in fluid communication with an overflow tank, or may be a hose connector fitting that secures to an overflow hose. Such an overflow tube/hose may be located within or behind the radiator so as to also be concealed, such as by being passed within and/or through the upper tank, the radiator core (or through a cutaway portion of the radiator core), and/or the lower tank, or behind or beside the upper tank, radiator core and lower tank, and then passing to an overflow tank located at a suitable location in the engine bay, again preferably being a concealed location.

Returning to the description provided above of the overflow functioning of a radiator filler neck and the pressure valve of a radiator cap, once overflow has passed through the lower opening of the filler neck (past the pressure valve forced open by the pressure in the radiator core and the cooling system), the overflow is able to pass through the overflow aperture, along the overflow passage within the side wall of the cylindrical body, and down to the overflow outlet in the bottom edge of the side wall.

With suitable overflow tubing or hosing secured to the overflow outlet, and passing through and out from within the upper tank to a non-pressurised overflow tank, the overflow is able to fill that overflow tank until the radiator and cooling system pressure reduces below the set point. In this respect, it will also be appreciated that the provision in the radiator cap of a two-way pressure valve will also then permit the transfer of coolant from the overflow tank back to the cooling system via the same pathway under suitable pressure conditions.

With the overflow outlet of the filler neck, and the associated outflow tubing or hosing, all able to be concealed from view, a radiator that utilises the filler neck of the present invention is thus visually simplified and smoothed.

BRIEF DESCRIPTION OF DRAWINGS

The radiator filler neck of the present invention will now be described with reference to preferred embodiments illustrated in the accompanying drawings. However, the following description of the preferred embodiments is not to limit the generality of the above description.

In the drawings.

DETAILED DESCRIPTION OF THE DRAWINGS

Figure 1A:
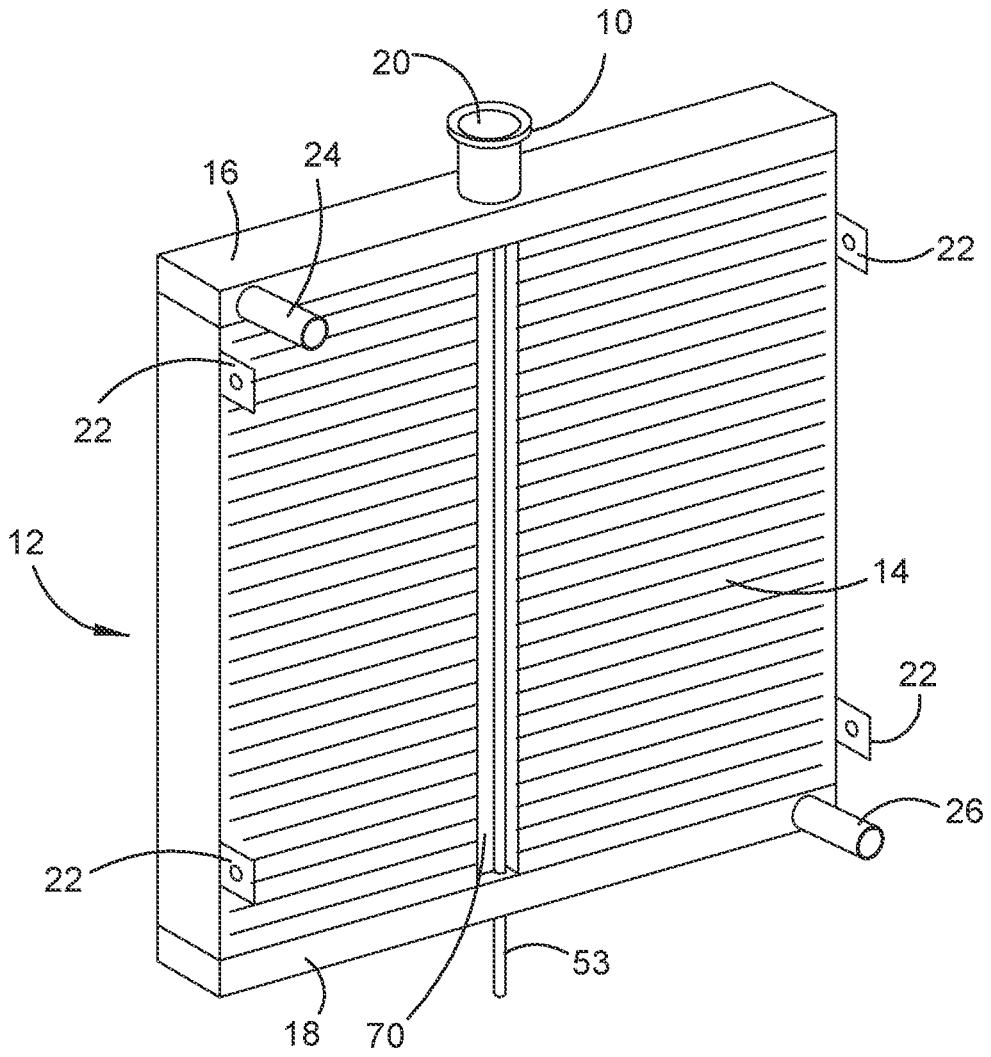
FIGS. 1*a*, 1*b* and 1*c* illustrate, respectively, a first embodiment of a radiator filler neck in situ with a radiator for a vehicle (FIG. 1*a*), an exploded schematic view of just the upper portion of that radiator (FIG. 1*b*), and an exploded section view of the radiator filler neck of that radiator (FIG. 1*c*)
Figure 1B:
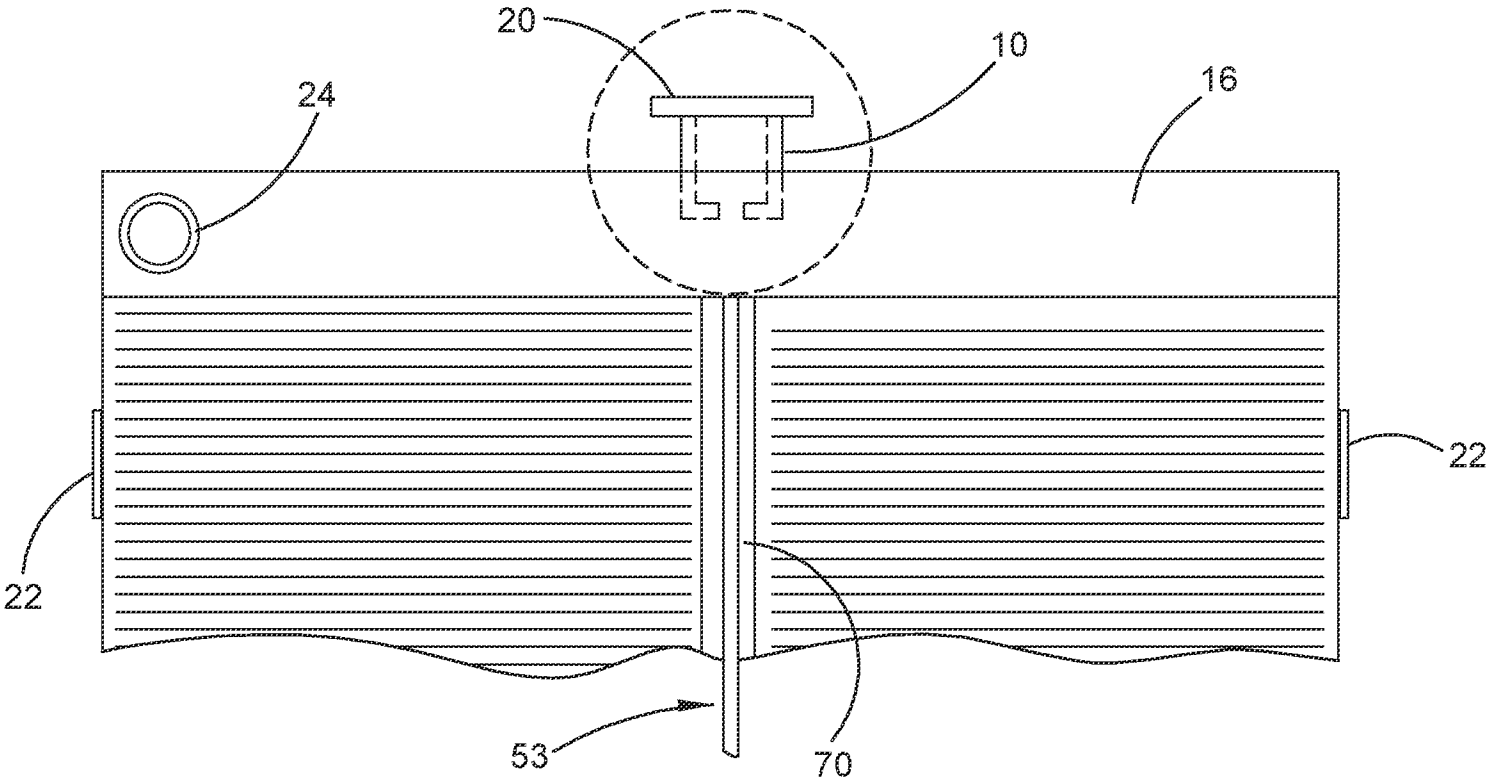

Illustrated in FIGS. 1*a* and 1*b* is a radiator filler neck 10 for use with a radiator 12 associated with, for example, the engine cooling system of a motor vehicle (not shown). The radiator 12 has a radiator core 14 between an upper tank 16 and a lower tank 18, and a pressure-valve radiator cap 20. Engine mounting members 22 are provided with the core 14 for mounting the radiator within the engine bay of the vehicle, and a coolant inlet 24 is provided in fluid communication with the upper tank 16, with a coolant outlet 26 provided in fluid communication with the lower tank 18.

Figure 1C:
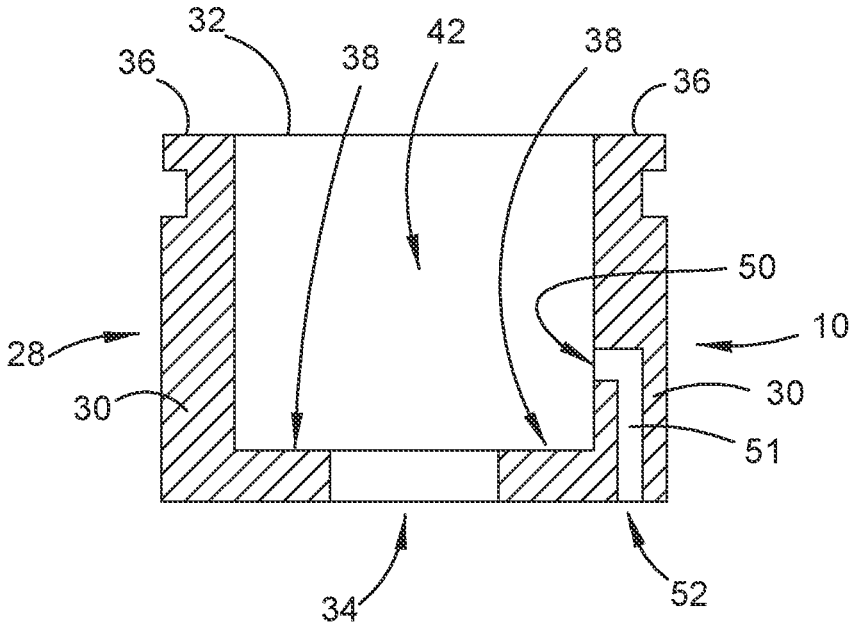

The filler neck 10 is shown in better detail in FIG. 1*c*, where the hollow cylindrical body 28 of the filler neck 10 is shown as having a cylindrical side wall 30 between an upper opening 32 and a lower opening 34. The upper opening 32 includes an upper sealing seat 36 for the radiator cap 20 shown in FIGS. 1*a* and 1*b*. The lower opening 34 includes an internal sealing seat 38 for the pressure valve 40 of the radiator cap 20 (the pressure valve 40 being shown in FIG. 2). In this form, the cylindrical body 28 thus has an interior 42 within the side wall 30 and between the upper and lower openings 32,34.

An overflow aperture 50 is provided in the interior 42 of the body 28, with the overflow aperture 50 located to permit transfer of overflow (as will be explained below) from the interior 42 of the filler neck 10 through an overflow passage 51 to an exterior, but concealed, overflow outlet 52 and then to an overflow tube 53 (evident in FIGS. 1*a*, 1*b* and 2).

Figure 2:
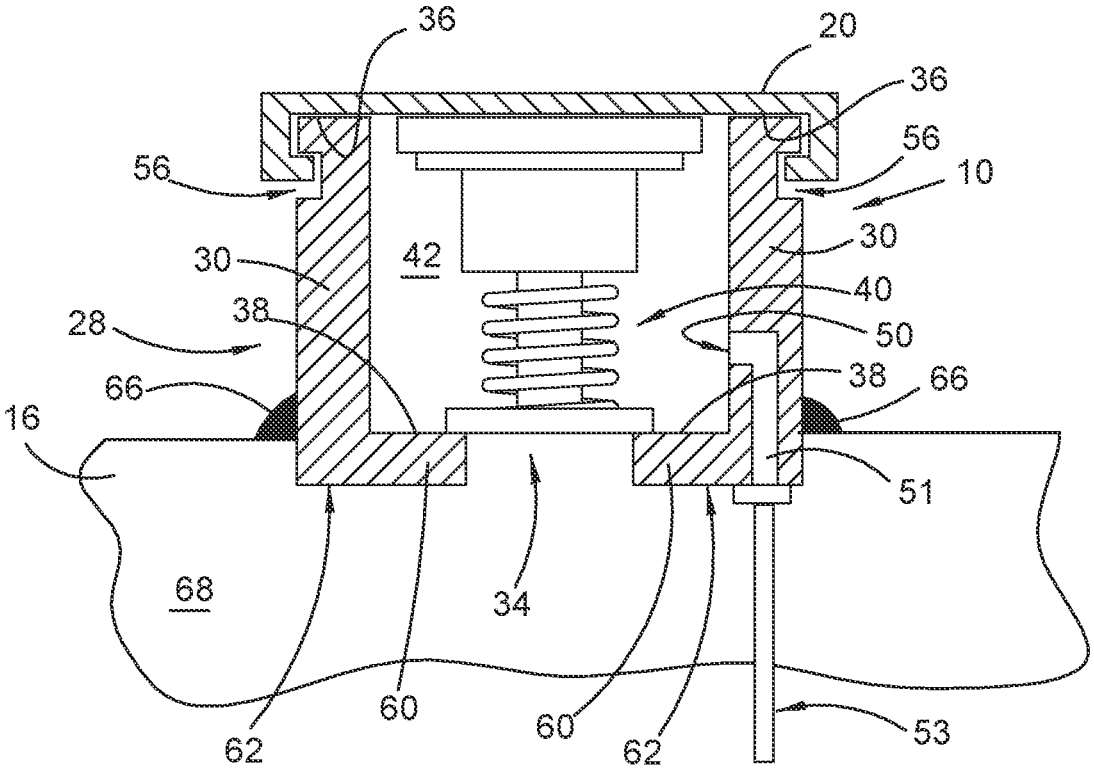
FIG. 2 illustrates an exploded section view of the radiator filler neck of FIG. 1*c* in situ.

As can be seen in FIG. 2, the cylindrical body 28 of the filler neck 10 is annular with a side wall 30 thickness that is large enough such that the side wall 30 forms, on its top edge at the upper opening 32, the upper sealing seat 36 upon which a sealing flange of a radiator cap 20 can rest so as to seal the filler neck 10 when properly engaged. Additionally, the filler neck 10 includes, on the exterior of the side wall 30 near the top edge thereof, suitable engagement grooves 56 in the side wall 30 for correspondingly shaped engagement lugs on the radiator cap 20 to slidingly engage when securing the radiator cap 20 to the filler neck 10. Therefore, the side wall 30 thickness of the cylindrical body 28 is large enough to allow formation of these engagement grooves 56 without impacting on the integrity of the filler neck 10.

The internal sealing seat 38 of the cylindrical body 28 is a radially inwardly directed annular flange 60 formed integrally with the bottom edge 62 of the cylindrical body 28, the flange 60 being wide enough such that the pressure valve 40 of the radiator cap 20 can seal against it when the radiator cap 20 is secured to the filler neck 10, as can be seen in FIG. 2.

The cylindrical body 28 of the filler neck 10 is rigidly secured by welding 66, at its lower end to an opening in the upper tank 16, so as to permit coolant to be added to the cooling system through the upper opening 32 of the filler neck 10, through the interior 42 of the cylindrical body 38 and through the lower opening 34 of the filler neck 10, to allow the radiator core 14, the lower tank 18 and the upper tank 16 to be filled with a suitable amount of coolant. This connection to the upper tank 16 results in a portion of the cylindrical body 38 being outside and above the upper tank 16, being a portion whose exterior is thus visible when the radiator 12 is in use, and a portion (a much smaller portion) being inside the upper tank 16 and thus being concealed when the radiator 12 is in use. Therefore, the bottom edge 62 of the cylindrical body 38 is within the interior 68 of the upper tank 16 and is concealed.

As generally described above, when the pressure within the radiator and engine cooling system increases above a set-point predetermined by the configuration of the pressure valve 40, the pressure valve 40 unseats and permits coolant to overflow through the lower opening 34 of the filler neck 10 from the radiator core 14 and the upper tank 16 into the interior 42 of the filler neck 10.

As mentioned above, the radiator filler neck 10 includes an overflow aperture 50 in the interior 42 of the cylindrical body 38, which is located to permit transfer of overflow from the interior 42 to an exterior overflow outlet 52, via an overflow passage 51 within the side wall 30, without the overflow aperture 50 or the overflow outlet 52 being externally visible on any portion of the side wall 30 that is externally visible in situ. In this respect, whether something is externally visible is determined from the point of view of a user viewing a fully assembled radiator in situ within the engine bay of a vehicle.

The overflow passage 51 is within the side wall 30 and passes therethrough to exit the filler neck 10 from the bottom edge 62 of the cylindrical body 28, the passage 51 thus being of a diameter that is less than the thickness of the side wall 30. The overflow aperture 50 could be located anywhere in the interior 42, and the overflow passage 52 could be of any suitable path and configuration through the side wall 30, and only need be configured so as to provide fluid communication from the interior through the passage to the overflow outlet. Additionally, although not shown in this embodiment, the filler neck 10 could have any number of overflow aperture/passage/outlet arrangements as necessary, each configured similarly to that described above, and ideally arranged symmetrically about the cylindrical body 28.

The overflow outlet 52 is shown as internally threaded aperture that is suitable for receiving and engaging with a threaded overflow tube 53, itself in fluid communication with an overflow tank (not shown). In this embodiment, the overflow tube 53 passes within and through the upper tank 16, and then along a cutaway portion 70 of the radiator core 14), through the lower tank 18, and then the overflow tank, again preferably in a concealed location.

Figure 3:
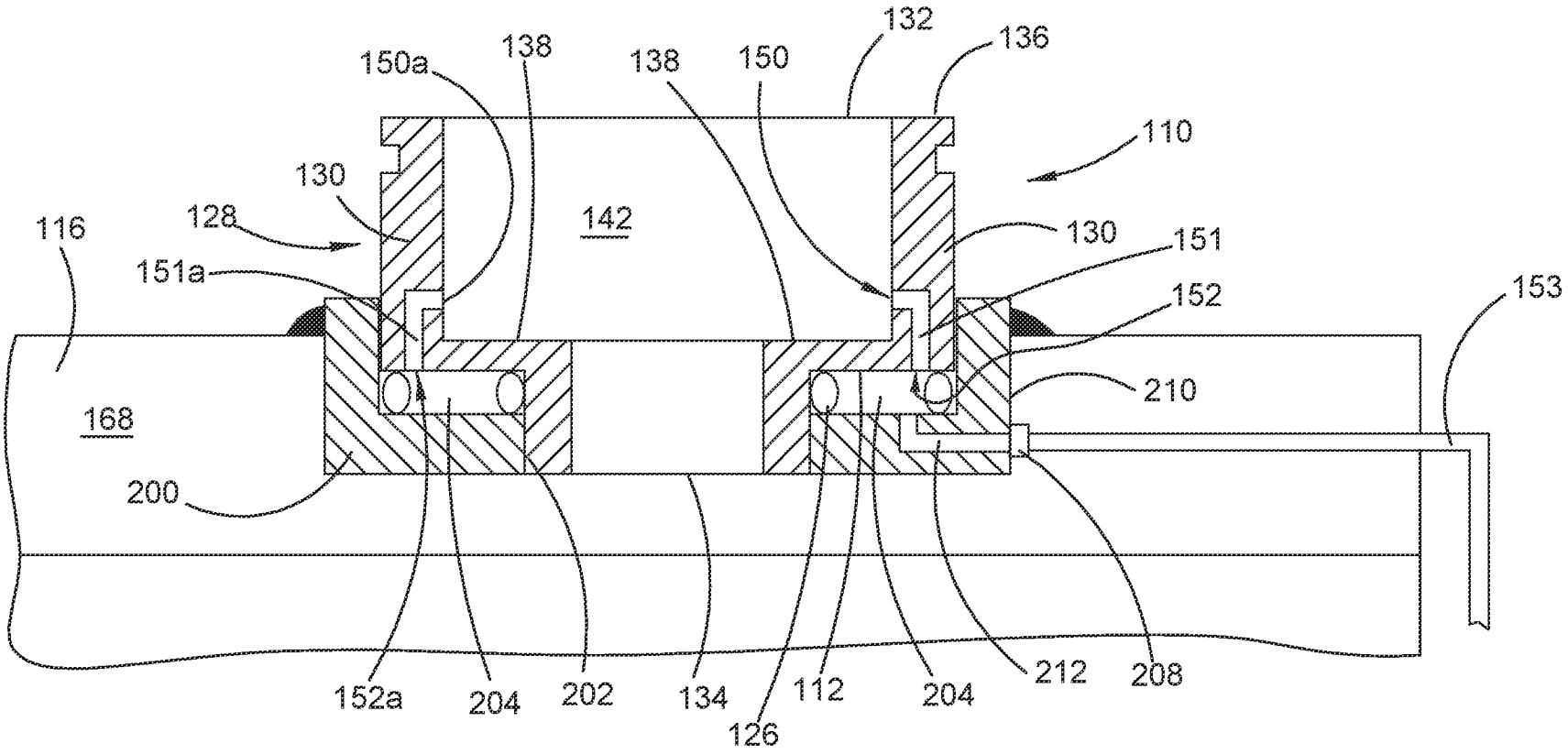
FIG. 3 illustrates an exploded section view of a second embodiment of a radiator filler neck in situ.

A second embodiment of a filler neck in accordance with the present invention is illustrated in FIG. 3, where the same reference numerals as used above for the first embodiment have been adopted, but in the 100 series.

Illustrated in FIG. 3 is a radiator filler neck 110 for use with a radiator (not shown) as generally described above. The hollow cylindrical body 128 of the filler neck 110 has a cylindrical side wall 130 between an upper opening 132 and a lower opening 134. The upper opening 132 includes an upper sealing seat 136 for a radiator cap (not shown). The lower opening 134 includes an internal sealing seat 138 for the pressure valve of a radiator cap. The cylindrical body 128 thus has an interior 142 within the side wall 130 and between the upper and lower openings 132,134.

Two opposing overflow apertures 150,150*a* are provided in the interior 142 of the body 128, with each overflow aperture 150,150*a* located to permit transfer of overflow from the interior 142 of the filler neck 110 through respective overflow passages 151,151*a* to respective concealed exterior overflow outlets 152,152*a*.

In this second embodiment though, the filler neck 110 is not attached directly to the upper tank 116, but is connected via an adaptor 200 that is itself welded to the upper tank 116. The adaptor 200 is sized to house the lower portion of the filler neck 110, engaging therewith via a threaded opening 202 and a correspondingly threaded skirt extending downwardly from the lower opening 134 of the filler neck 110, to form an overflow chamber 204 therebetween suitably sealed with O-rings 206,208.

Thus, the overflow outlets 152,152*a* are not connected directly to the overflow tube 153, but are connected via the overflow chamber 204 and an associated overflow chamber aperture 210 and passageway 212, and then to the overflow tube 153.

This connection to the upper tank 116 again results in a portion of the cylindrical body 138 being outside and above the upper tank 116, being a portion whose exterior is thus visible when the radiator is in use, and a portion being inside the upper tank 116 and thus being concealed when the radiator is in use. Therefore, the bottom edge 162 of the cylindrical body 138 is again within the interior 168 of the upper tank 116 such that the overflow outlet 152 is concealed and thus the side wall 130 does not include a visible exterior overflow outlet.

Figure 4A:
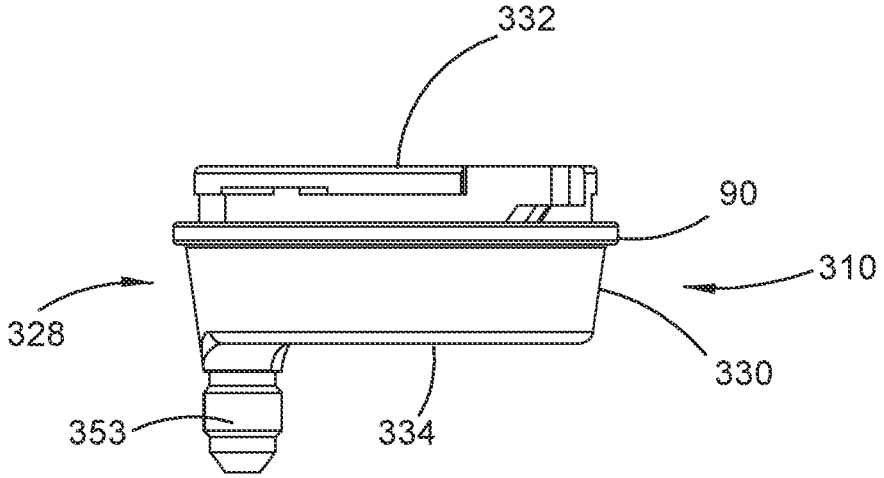
FIGS. 4*a* and 4*b* illustrate side and top views of a third embodiment of a radiator filler neck also in accordance with the present invention.
Figure 4B:
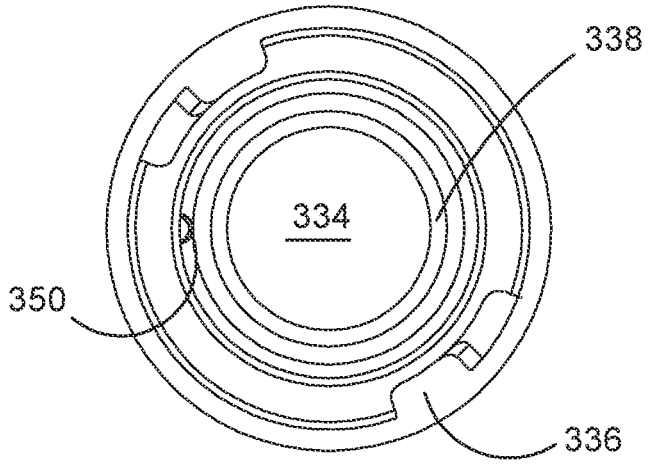

A third embodiment of a filler neck in accordance with the present invention is illustrated in FIGS. 4*a* and 4*b*, where the same reference numerals as used above for the first embodiment have been adopted, but in the 300 series.

Illustrated in FIGS. 4*a* and 4*b* is a radiator filler neck 310 for use with a radiator (not shown) as generally described above. The hollow cylindrical body 328 of the filler neck 310 has a cylindrical side wall 330 between an upper opening 332 and a lower opening 334. The upper opening 332 includes an upper sealing seat 336 for a radiator cap (not shown). The lower opening 334 includes an internal sealing seat 338 for the pressure valve of a radiator cap. The cylindrical body 328 thus has an interior within the side wall 330 and between the upper and lower openings 332,334.

An overflow aperture 350 is provided in the interior of the body 328, with the overflow aperture 350 located to permit transfer of overflow from the interior of the filler neck 310 through an overflow passage (not shown) to a concealed exterior overflow outlet (not shown) and then to an overflow tube 353. In this embodiment, the connection of the filler neck 310 to a radiator tank (not shown) may be at any point along the sidewall 330, although will ideally be closely adjacent the underside of the flange 90, such that the overflow outlet and the overflow tube 353 are concealed and thus the side wall 330 does not include a visible exterior overflow outlet or overflow tube.

Figure 5A:
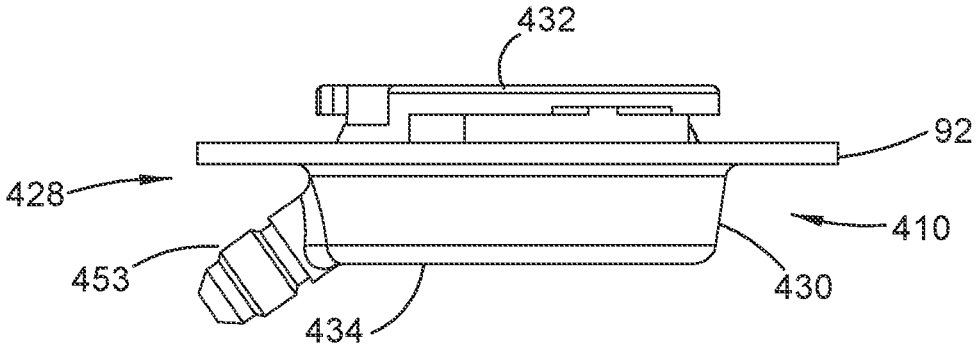
FIGS. 5*a* and 5*b* illustrate side and top views of a fourth embodiment of a radiator filler neck also in accordance with the present invention

A fourth embodiment of a filler neck in accordance with the present invention is illustrated in FIGS. 5*a* and 45, where the same reference numerals as used above for the first embodiment have been adopted, but in the 400 series.

Figure 5B:
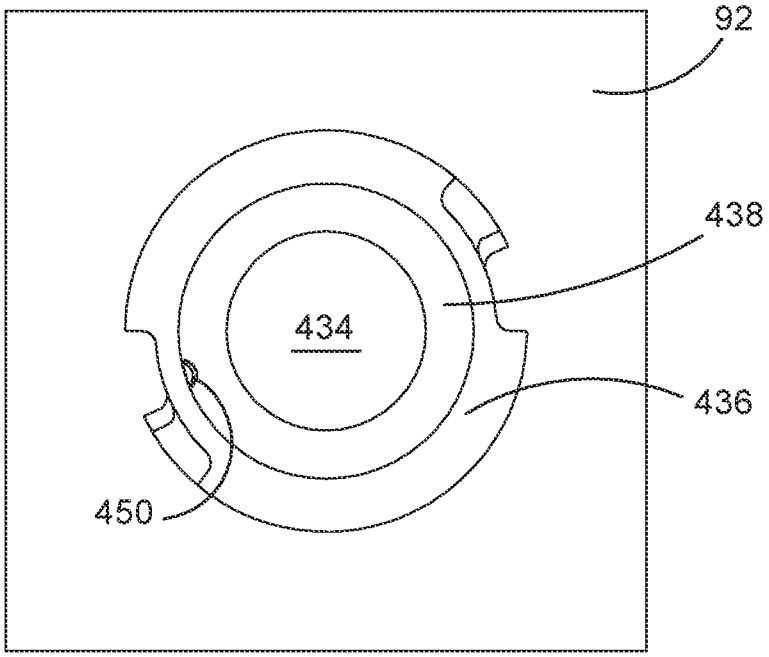

Illustrated in FIGS. 5*a* and 5*b* is a radiator filler neck 410 for use with a radiator (not shown) as generally described above. The hollow cylindrical body 428 of the filler neck 410 has a cylindrical side wall 430 between an upper opening 432 and a lower opening 434. The upper opening 432 includes an upper sealing seat 436 for a radiator cap (not shown). The lower opening 434 includes an internal sealing seat 438 for the pressure valve of a radiator cap. The cylindrical body 428 thus has an interior within the side wall 430 and between the upper and lower openings 432,434.

An overflow aperture 450 is provided in the interior of the body 428, with the overflow aperture 450 located to permit transfer of overflow from the interior of the filler neck 410 through an overflow passage (not shown) to a concealed exterior overflow outlet (not shown) and then to an overflow tube 453. In this embodiment, the connection of the filler neck 410 to a radiator tank (not shown) will ideally be closely adjacent the underside of the large, square flange 92, such that the overflow outlet and the overflow tube 453 are again concealed within the radiator tank below the flange and thus the exposed part of the side wall 430, above the flange 92, does not include a visible exterior overflow outlet or overflow tube.

Finally, it will be understood that there may be other variations and modifications made to the configurations described above that will also be within the scope of the present invention.

The invention claimed is:

1. A radiator filler neck for use with a radiator, the radiator having a core between upper and lower tanks, and a pressure-valve radiator cap, the filler neck including:

a hollow cylindrical body including a side wall between upper and lower openings, the upper opening including an upper sealing seat for the radiator cap, the lower opening including an internal sealing seat for the pressure valve of the radiator cap, the body thus having an interior within the side wall and between the upper and lower openings;

wherein an overflow aperture is provided in the interior of the body to permit transfer of overflow from the interior via an overflow passage to a concealed exterior overflow outlet, and wherein the side wall does not include a visible exterior overflow outlet.

2. A radiator filler neck according to claim 1, wherein the cylindrical body is annular such that the side wall includes a top edge at the upper opening, the top edge forming the upper sealing seat, and a bottom edge at the lower opening.

3. A radiator filler neck according to claim 2, wherein the internal sealing seat is a radially inwardly directed annular flange formed integrally with the bottom edge of the cylindrical body.

4. A radiator filler neck according to claim 2, wherein the overflow passage is provided within the side wall from the overflow aperture of the cylindrical body interior to the overflow outlet.

5. A radiator filler neck according to claim 1, wherein the overflow passage passes within and through the sidewall to exit the filler neck from the bottom edge of the cylindrical body.

6. A radiator filler neck according to claim 1, wherein the overflow outlet is suitable for receiving and engaging with an overflow tube or hose that is in fluid communication with an overflow tank.

7. A radiator filler neck according to claim 1, wherein more than one overflow aperture is provided in the interior of the body, each in association with an overflow passage and an overflow outlet.

8. A radiator filler neck according to claim 1, including an adaptor sized to house the lower portion of the filler neck, the filler neck including a threaded skirt for engaging therewith via a threaded opening of the adaptor, the adaptor and filler neck forming therebetween an overflow chamber.

9. A radiator filler neck according to claim 8, wherein the overflow outlets are not connected directly to an overflow tube but are connected via the overflow chamber and an associated overflow chamber aperture and passageway, and then to the overflow tube.

10. A radiator having a core between upper and lower tanks, a pressure-valve radiator cap, and a filler neck in accordance with claim 1.

11. A radiator according to claim 10 including an overflow tank in fluid communication, via an overflow tube or hose, with the overflow outlet of the filler neck.

12. A radiator according to claim 10, wherein the overflow tube is concealed by the upper tank or the radiator core and is thus, in use, not externally visible.

* * * * *